US010975892B2

(12) United States Patent
Bailes

(10) Patent No.: US 10,975,892 B2
(45) Date of Patent: Apr. 13, 2021

(54) HYDRAULIC RESERVOIR WITH A VORTEX FOR DEAERATION OF THE HYDRAULIC OIL

(71) Applicant: LEWMAR LIMITED, Hampshire (GB)

(72) Inventor: David Frank Bailes, Portsmouth (GB)

(73) Assignee: LEWMAR LIMITED, Hampshire (GB)

( * ) Notice: Subject to any disclaimer, the term of this patent is extended or adjusted under 35 U.S.C. 154(b) by 180 days.

(21) Appl. No.: 16/349,156

(22) PCT Filed: Nov. 8, 2017

(86) PCT No.: PCT/EP2017/078668
§ 371 (c)(1),
(2) Date: May 10, 2019

(87) PCT Pub. No.: WO2018/087184
PCT Pub. Date: May 17, 2018

(65) Prior Publication Data

US 2019/0285092 A1 Sep. 19, 2019

(30) Foreign Application Priority Data

Nov. 14, 2016 (GB) ..... 1619225

(51) Int. Cl.
*F15B 1/26* (2006.01)
*F15B 21/044* (2019.01)

(52) U.S. Cl.
CPC ..... *F15B 1/265* (2013.01); *F15B 21/044* (2013.01)

(58) Field of Classification Search
CPC ..... F15B 1/265; F15B 21/044; F15B 1/26
(Continued)

(56) References Cited

U.S. PATENT DOCUMENTS 3,003,659 A 10/1961 Miller
4,064,911 A 12/1977 Albrecht
(Continued)

FOREIGN PATENT DOCUMENTS

EP 0831238 A2 10/1997
EP 0831238 3/1998
(Continued)

OTHER PUBLICATIONS

International Search Report (ISR) and written opinion of the international application PCT/EP2017/078668, dated Mar. 2, 2018. 14 pages.

(Continued)

*Primary Examiner* — F Daniel Lopez
*Assistant Examiner* — Daniel S Collins
(74) *Attorney, Agent, or Firm* — Leason Ellis LLP

(57) ABSTRACT

A hydraulic reservoir (10), for use for example in a marine pleasure craft, comprises a vortex chamber (16), a hydraulic fluid return line (18) and a hydraulic fluid suction line (20) respective entering and exiting substantially tangentially to an internal wall surface of the vortex chamber. An upper chamber (26) is disposed above the vortex chamber (16) and in fluid communication with the vortex chamber. The upper chamber is capable of expansion and/or contraction in use in order to adjust continuously to the volume of the hydraulic fluid to be accommodated in the hydraulic reservoir. Also disclosed is a method of operating such a hydraulic reservoir, in which hydraulic fluid is directed into the vortex chamber (16) along the hydraulic fluid return line (18) and extracting hydraulic fluid from the vortex chamber along the hydraulic fluid suction line (20), to thereby generate a vortex flow in the vortex chamber. Dissolved air, if present, becomes entrained into bubbles which rise to the upper chamber (26). Expansion and/or contraction of the upper
(Continued)

SECTION B-B chamber (26) is provided in order to adjust continuously to the volume of the hydraulic fluid to be accommodated in the hydraulic reservoir (10).

20 Claims, 11 Drawing Sheets

(58) Field of Classification Search
USPC ..... 137/255, 264
See application file for complete search history.

(56) References Cited

U.S. PATENT DOCUMENTS

| | | | | |
|---|---|---|---|---|
| 2008/0173362 | A1 | 7/2008 | Wong et al. | |
| 2015/0075383 | A1 | 3/2015 | Doll | |
| 2016/0061234 | A1* | 3/2016 | Doll | F15B 1/26 137/808 |

FOREIGN PATENT DOCUMENTS

| | | | |
|---|---|---|---|
| EP | 2048368 | A2 | 6/2008 |
| EP | 2 048 368 | | 4/2009 |
| WO | WO2016204118 | A1 | 12/2016 |

OTHER PUBLICATIONS

British search report in corresponding British Patent Application No. GB1619225.4, dated May 10, 2017. 3 pages.

* cited by examiner

SECTION B-B

SECTION C-C

HYDRAULIC RESERVOIR WITH A VORTEX FOR DEAERATION OF THE HYDRAULIC OIL

CROSS-REFERENCE TO RELATED PATENT APPLICATIONS

This application is a U.S. National Phase Application under 35 U.S.C. § 371 of International Patent Application No. PCT/EP2017/078668, filed Nov. 8, 2017, which claims the priority of British Patent Application No. 1619225.4, filed Nov. 14, 2016, each of which is incorporated by reference as if expressly set forth in their respective entirety herein.

BACKGROUND TO THE INVENTION

Field of the Invention

The present invention relates to a reservoir, such as a hydraulic reservoir and a method for the operation of a reservoir, such as a hydraulic reservoir. It has particular, but not necessarily exclusive, application to marine applications such as for pleasure craft.

Related Art

Hydraulic systems typically require a reservoir for hydraulic fluid. In known systems, the hydraulic reservoir provides a de-aeration function in that the hydraulic fluid is allowed to stand so that dissolved or entrained air (or other gas) can form bubbles and gradually rise out of the fluid into a head space. However, such an approach typically requires that the hydraulic reservoir has a substantial capacity, to allow the hydraulic fluid sufficient time to stand to allow de-aeration. Such reservoirs may also require complex baffle structures to promote suitable standing of the hydraulic fluid.

EP-A-0831238 discloses a hydraulic fluid reservoir with a cylindrical chamber with a tangentially-oriented inlet and a tangentially-oriented outlet. This is disclosed as being to preserve the momentum of hydraulic fluid fed into the reservoir. The hydraulic fluid therefore adopts rotational flow in the cylindrical chamber, so that air included in the hydraulic fluid is forced towards the centre of the chamber. An annular disc having a central opening is provided above the chamber. Air released from the hydraulic fluid passes through the central opening and then out of the reservoir via a hole in the upper wall of the reservoir. It is therefore clear that the hydraulic fluid in the reservoir of EP-A-0831238 is open to the atmosphere.

SUMMARY OF THE INVENTION

The present inventors have realised that further improvements of the general approach taken in EP-A-0831238 are possible. In particular, the present inventors have realised that there could be substantial advantages if the interior of the hydraulic reservoir is not open to the atmosphere in use. This would allow dissolved air in the hydraulic fluid to be removed in the reservoir, and then since the hydraulic fluid would not be subsequently exposed to the atmosphere, there would be little or no opportunity for the hydraulic fluid to have further air dissolved into it. This would further enhance the operational efficiency of the hydraulic system. However, taking the approach of sealing the hydraulic reservoir from the atmosphere in use then reveals further issues to be considered, such as how the system can cope with volume changes of the hydraulic fluid, for example due to thermal expansion and contraction.

The present invention has been devised in order to address at least one of the problems identified above. Preferably, the present invention reduces, ameliorates, avoids or overcomes at least one of the above problems.

Accordingly, in a first preferred aspect, the present invention provides a hydraulic reservoir comprising:

- a vortex chamber having a substantially cylindrical internal wall surface;
- a hydraulic fluid return line entering substantially tangentially to the internal wall surface of the vortex chamber;
- a hydraulic fluid suction line exiting substantially tangentially from the internal wall surface of the vortex chamber;
- an upper chamber, disposed in use above the vortex chamber and in fluid communication with the vortex chamber, wherein the upper chamber is capable of expansion and/or contraction in use in order to adjust continuously to the volume of the hydraulic fluid to be accommodated in the hydraulic reservoir.

In a second preferred aspect, the present invention provides a method for the operation of a hydraulic reservoir, the hydraulic reservoir comprising:

- a vortex chamber having a substantially cylindrical internal wall surface;
- a hydraulic fluid return line entering substantially tangentially to the internal wall surface of the vortex chamber;
- a hydraulic fluid suction line exiting substantially tangentially from the internal wall surface of the vortex chamber;
- an upper chamber, disposed in use above the vortex chamber and in fluid communication with the vortex chamber, the method including the step:

- directing hydraulic fluid into the vortex chamber along the hydraulic fluid return line and extracting hydraulic fluid from the vortex chamber along the hydraulic fluid return line, thereby generating a vortex flow in the vortex chamber, dissolved air, if present, becoming entrained into bubbles which rise to the upper chamber, expansion and/or contraction of the upper chamber being provided in use in order to adjust continuously to the volume of the hydraulic fluid to be accommodated in the hydraulic reservoir.

In a third preferred aspect, the present invention provides a hydraulic system including a hydraulic pump operatively linked to a hydraulic reservoir according to the first aspect.

In a fourth preferred aspect, the present invention provides a marine pleasure craft having a hydraulic system according to the first aspect.

The present invention therefore allows the hydraulic fluid to be separated from the atmosphere in use, with expansion and/or contraction of the hydraulic fluid being accommodated by the expansion and/or contraction of the upper chamber.

The first, second, third and/or fourth aspect of the invention may have any one or, to the extent that they are compatible, any combination of the following optional features.

It is recognised by the inventors that the present invention has utility in removing gas such as air from any fluid-filled system. It is therefore not necessarily limited only to hydraulic systems, although its application to hydraulic systems is at the time of writing a preferred application.

Preferably, the upper chamber has a flexible wall portion adapted to flex to provide the required expansion and/or contraction in use. In this case, the flexible wall portion may comprise a bellow or bellows.

The upper chamber may have a minimum volume, defined by the limit of available contraction, and a maximum volume, defined by the limit of available expansion, wherein the ratio of maximum volume to minimum volume is at least 1.03. This assumes a typical average coefficient of expansion of 0.0007° $C.^{-1}$, cold startup at 15° C. and a maximum temperature of 60° C.

Preferably, the upper chamber has a transparent cover located at its upper end. This allows a user to check to see whether there is any free air trapped in the upper chamber.

Preferably, there is a bleed valve provided at the upper extremity of the upper chamber, to allow trapped air to be bled from the upper chamber in use. This is a straightforward and practical way for the user to remove air from the upper chamber without the need to open the vortex chamber to the atmosphere.

The vortex chamber and the upper chamber may be separated by a diffuser plate. In this case, the diffuser plate has a shape which tapers upwardly from a periphery of the diffuser plate towards an aperture formed in the diffuser plate. This shape allows bubbles, which migrate to the central axis of the vortex chamber, to rise upwards, being guided to the aperture by the taper of the plate. The bubbles therefore reach the upper chamber.

Preferably, the hydraulic fluid return line enters the vortex chamber at an upper portion of the vortex chamber. Furthermore, preferably the hydraulic fluid suction line exits the vortex chamber at a lower portion of the vortex chamber.

Preferably, the hydraulic reservoir has a capacity of not more than 30 litres. This is a typical maximum scale for leisure boat applications, for example.

The method of the invention may further include the step of bleeding trapped air from the upper chamber using the bleed valve.

In operation, the method of operating the hydraulic reservoir includes flexible wall portion to during flow of hydraulic fluid in the vortex chamber, thereby providing the required expansion and/or contraction of the upper chamber.

The volume of the hydraulic fluid to be accommodated in the hydraulic reservoir typically varies, at least in part, due to thermal expansion of the hydraulic fluid.

Preferably, where the vortex chamber and the upper chamber are separated by a diffuser plate, bubbles formed in the vortex chamber are guided into the upper chamber due to the tapered shape of the diffuser plate.

Preferably, the diffuser plate substantially prevents the vortex in the vortex chamber extending into the upper chamber.

It is particularly preferred that, at least in use of the hydraulic system, preferable the hydraulic fluid in the hydraulic reservoir is not in contact with the atmosphere. This allows the hydraulic fluid to be at a pressure above atmospheric pressure. A typical rest gauge pressure, for example, in the upper chamber is at least 25 kPa, more preferably about 50 kPa. The pressure in this region is induced by the natural tendency of the bellows to return to rest.

Further optional features of the invention are set out below.

BRIEF DESCRIPTION OF THE DRAWINGS

Embodiments of the invention will now be described by way of example with reference to the accompanying drawings in which.

Figure 1:
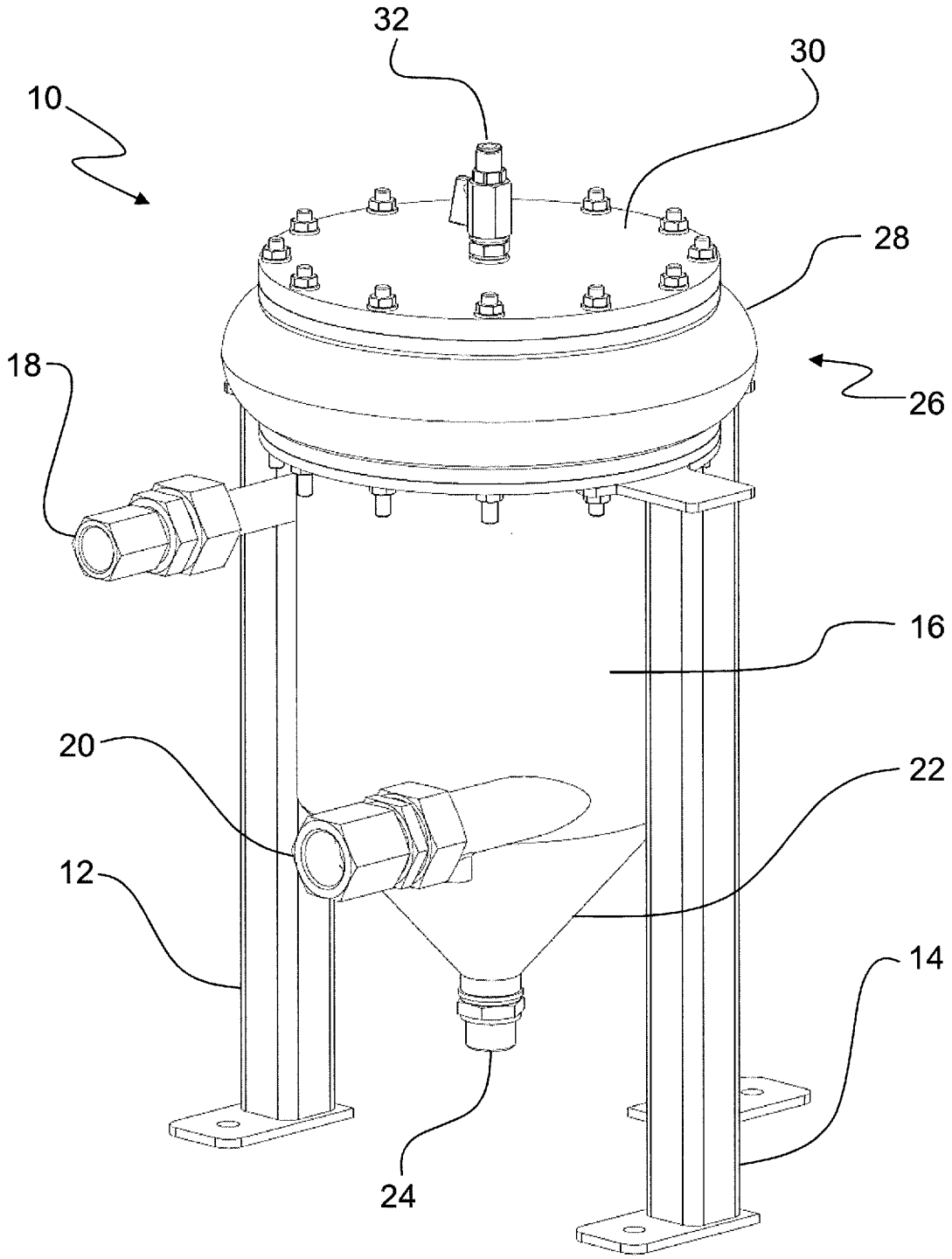
FIG. 1 shows a perspective view of a hydraulic reservoir and its associated support structure according to an embodiment of the invention.

DETAILED DESCRIPTION OF THE PREFERRED EMBODIMENTS, AND FURTHER OPTIONAL FEATURES OF THE INVENTION

The preferred embodiments of the present invention provide a variable volume centrifugal hydraulic reservoir. It is intended that a reservoir according to the present embodiments can completely replace the hydraulic reservoir in known hydraulic systems. The specific constructional details of the preferred embodiments will be discussed in more detail below. First, it is possible to set out some advantages of the preferred embodiments compared with known hydraulic reservoirs.

The use of a hydraulic reservoir according to the preferred embodiments allows the use of a reduced reservoir fluid volume compared with prior art approaches in which the hydraulic fluid is allowed to stand for de-aeration. The approach of using a vortex allows significant removal of entrained air present in the fluid. In the preferred embodiment, the hydraulic fluid is prevented from coming into contact with the atmosphere. This reduces the opportunity for further air to be dissolved in the hydraulic fluid. It also prevents moisture absorption by the hydraulic fluid. The use of the vortex permits there to be increased pressure in the pump suction lines and decreased pressure in the drain return lines. Overall, this results in higher system efficiency and also higher space efficiency, because the overall volume of the hydraulic reservoir can be kept small, corresponding in use to the volume of hydraulic fluid needing to be help in the reservoir.

In the drawings, features are indicated using reference numerals. Where the same feature is shown in more than one drawing, the reference numeral may be omitted if it has already been described with reference to an earlier drawing.

FIG. 1 shows a perspective view of a hydraulic reservoir 10 and its associated support structure 12, 14, the hydraulic reservoir being according to an embodiment of the invention. A vortex chamber 16 has a generally cylindrical shape in an axial range between a hydraulic fluid return line 18 and a hydraulic fluid suction line 20. At the lower part of the hydraulic reservoir is provided a frustoconical sump 22 tapering towards a drain line 24.

Upper chamber 26 is disposed above vortex chamber 16. Upper chamber 26 has a flexible rubber side wall 28 in the form of bellows. Upper chamber 26 is closed at its upper end by transparent lid member 30 which has a bleed valve 32 formed through it.

Figure 2:
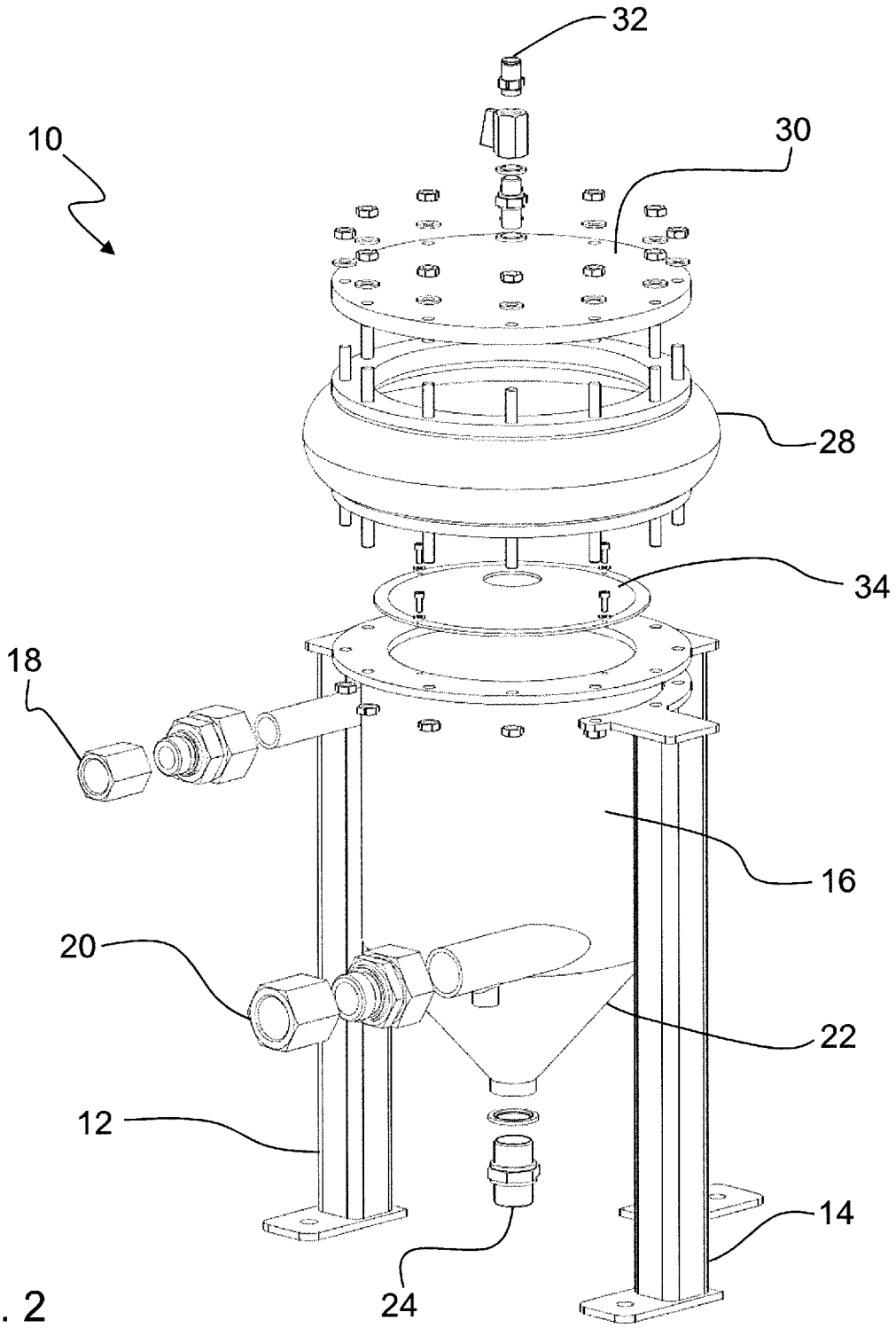
FIG. 2 shows a perspective exploded view of the hydraulic reservoir of FIG. 1.

FIG. 2 shows a perspective exploded view of the hydraulic reservoir of FIG. 1, showing how the different parts of the reservoir are fixed together.

Figure 3:
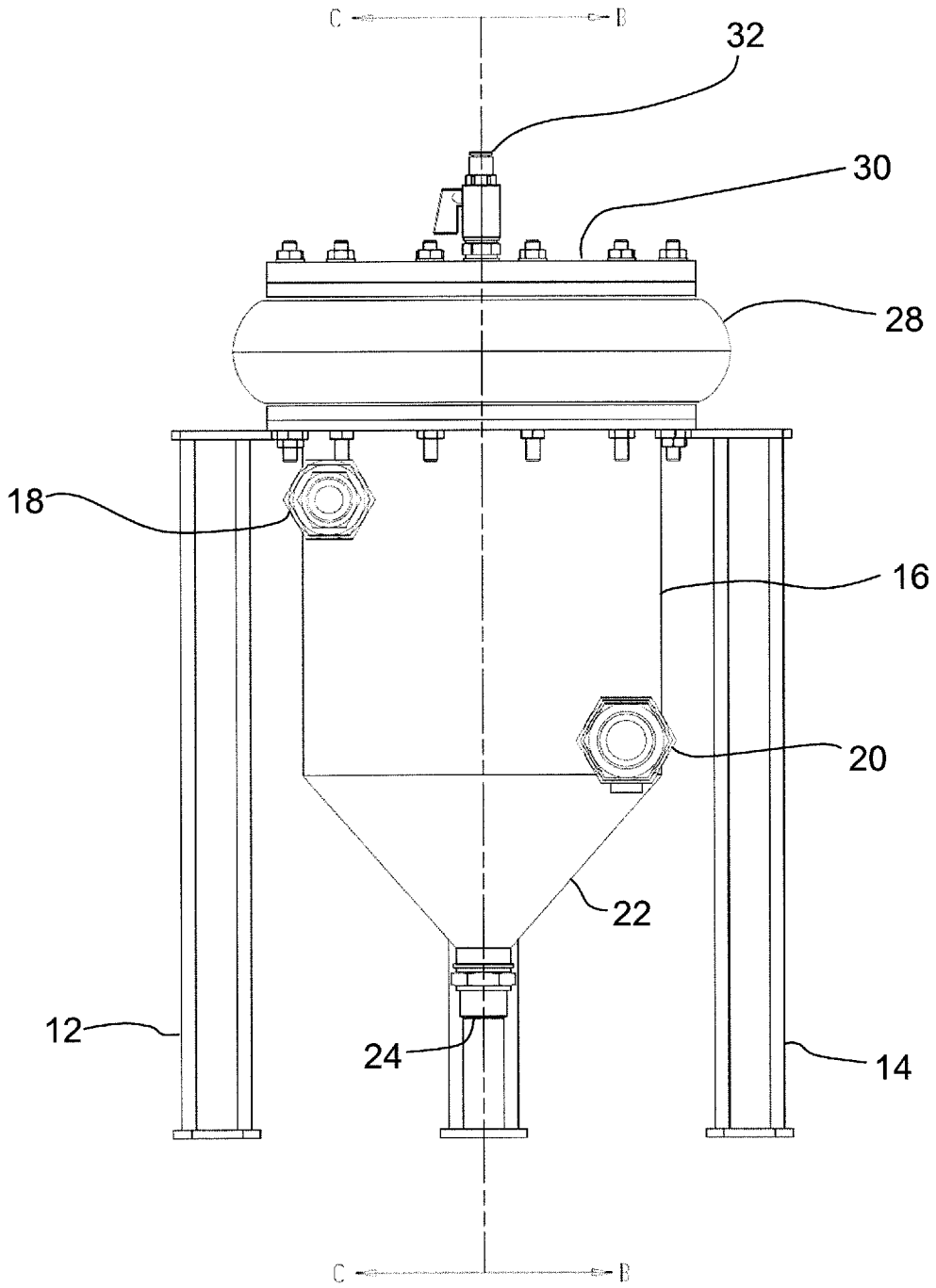
FIG. 3 shows a front view of the hydraulic reservoir of FIG. 1.

FIG. 3 shows a front view of the hydraulic reservoir of FIG. 1. FIG. 3 shows the axial offset between the hydraulic fluid return line 18 and a hydraulic fluid suction line 20.

Figure 4:
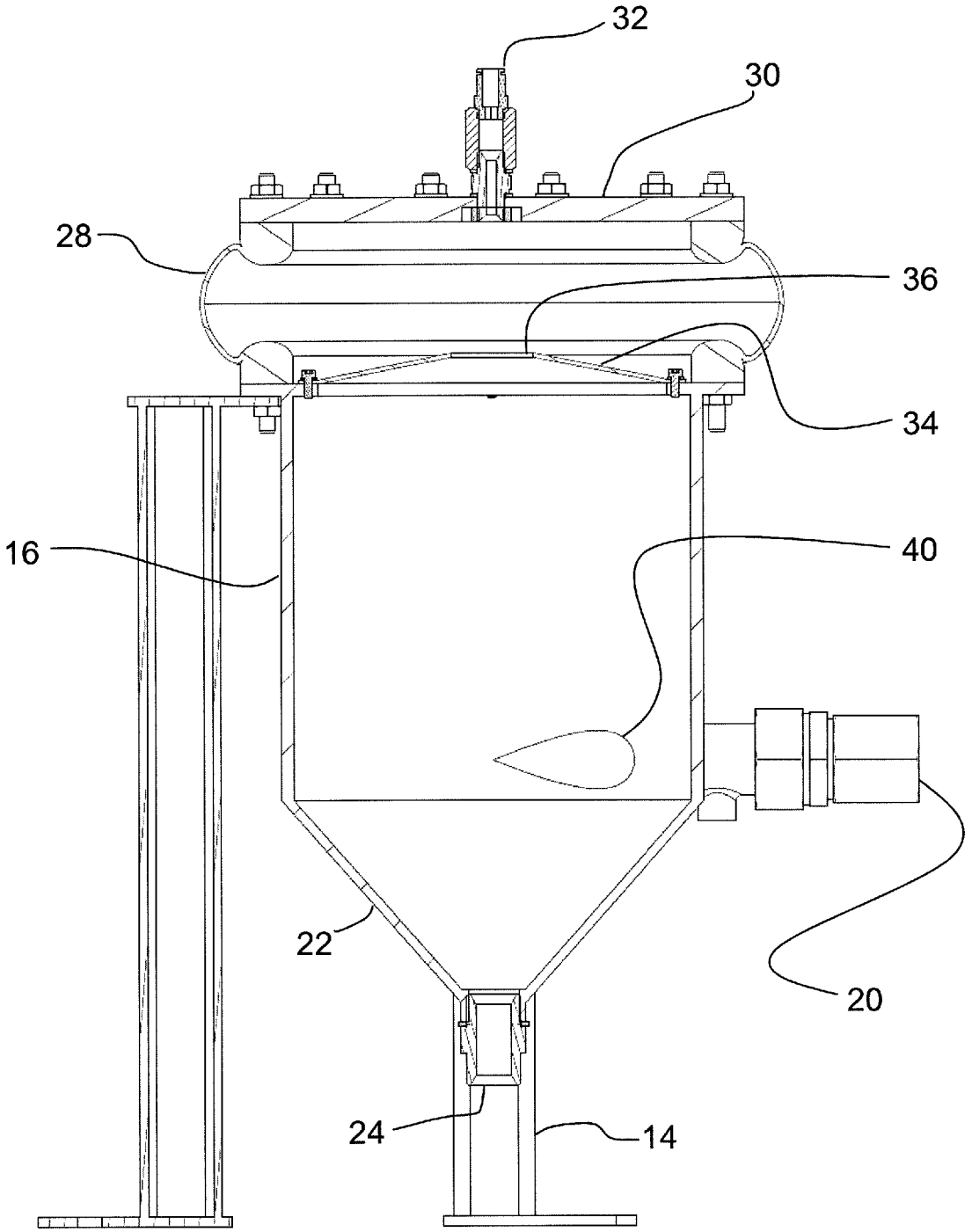
FIG. 4 shows a longitudinal sectional view along B-B in FIG. 3.

FIG. 4 shows a longitudinal sectional view along B-B in FIG. 3. FIG. 4 shows the tangential junction 40 between the hydraulic fluid suction line 20 and the interior cylindrical wall of the vortex chamber 16. FIG. 4 also shows diffuser plate 34 which tapers upwardly from its outer periphery towards a central aperture 36.

Figure 5:
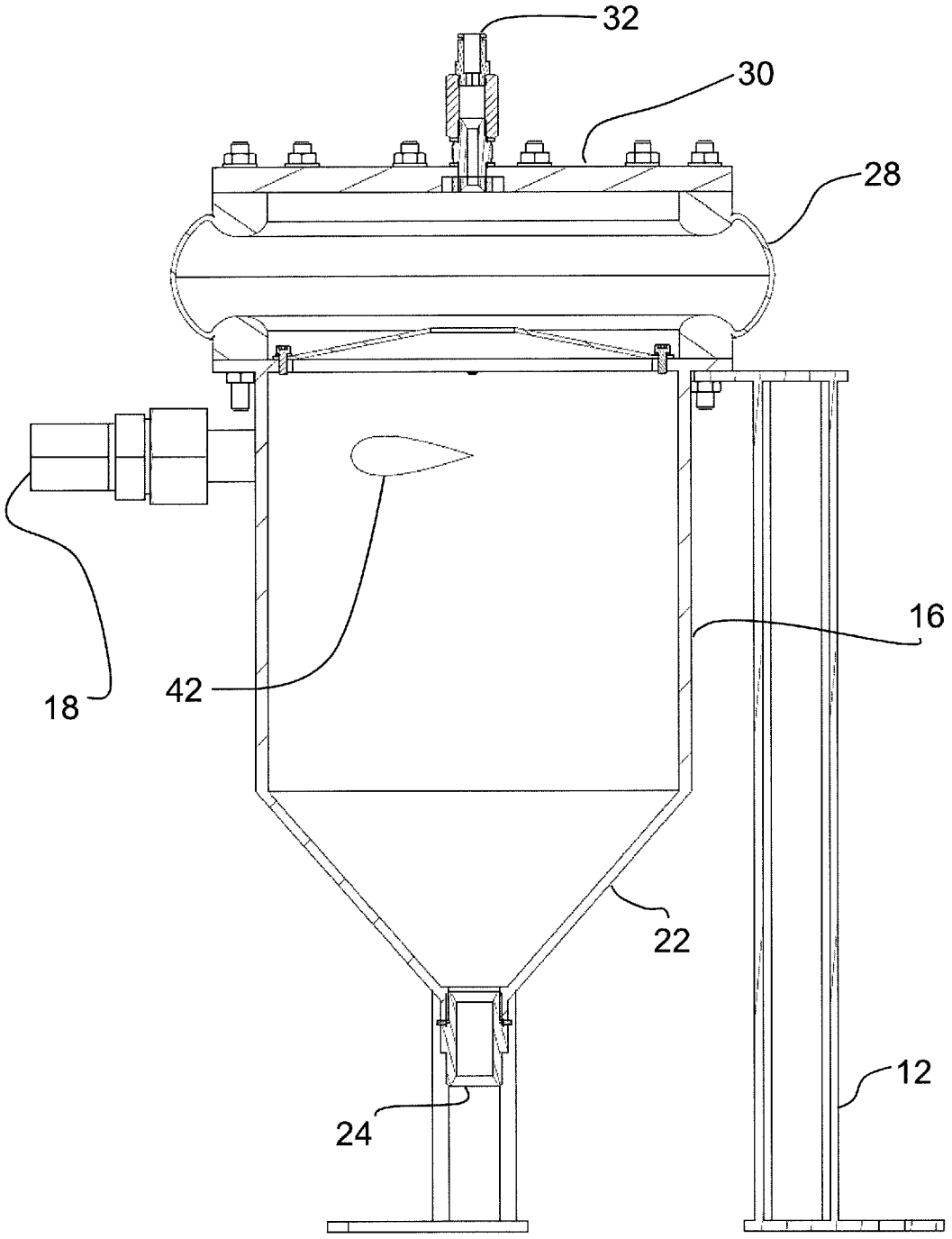
FIG. 5 shows a longitudinal sectional view along C-C in FIG. 3.

FIG. 5 shows a longitudinal sectional view along C-C in FIG. 3. FIG. 5 shows the tangential junction 42 between the hydraulic fluid return line 18 and the interior cylindrical wall of the vortex chamber 16.

The hydraulic fluid return line 18 enters tangentially to the upper end of the cylindrical vortex chamber 16. The hydraulic fluid outlet line 20 (suction line) exits tangentially at the lower end of the cylindrical vortex chamber 16, at the opposite side of the vortex chamber to the return line 18.

Figure 6:
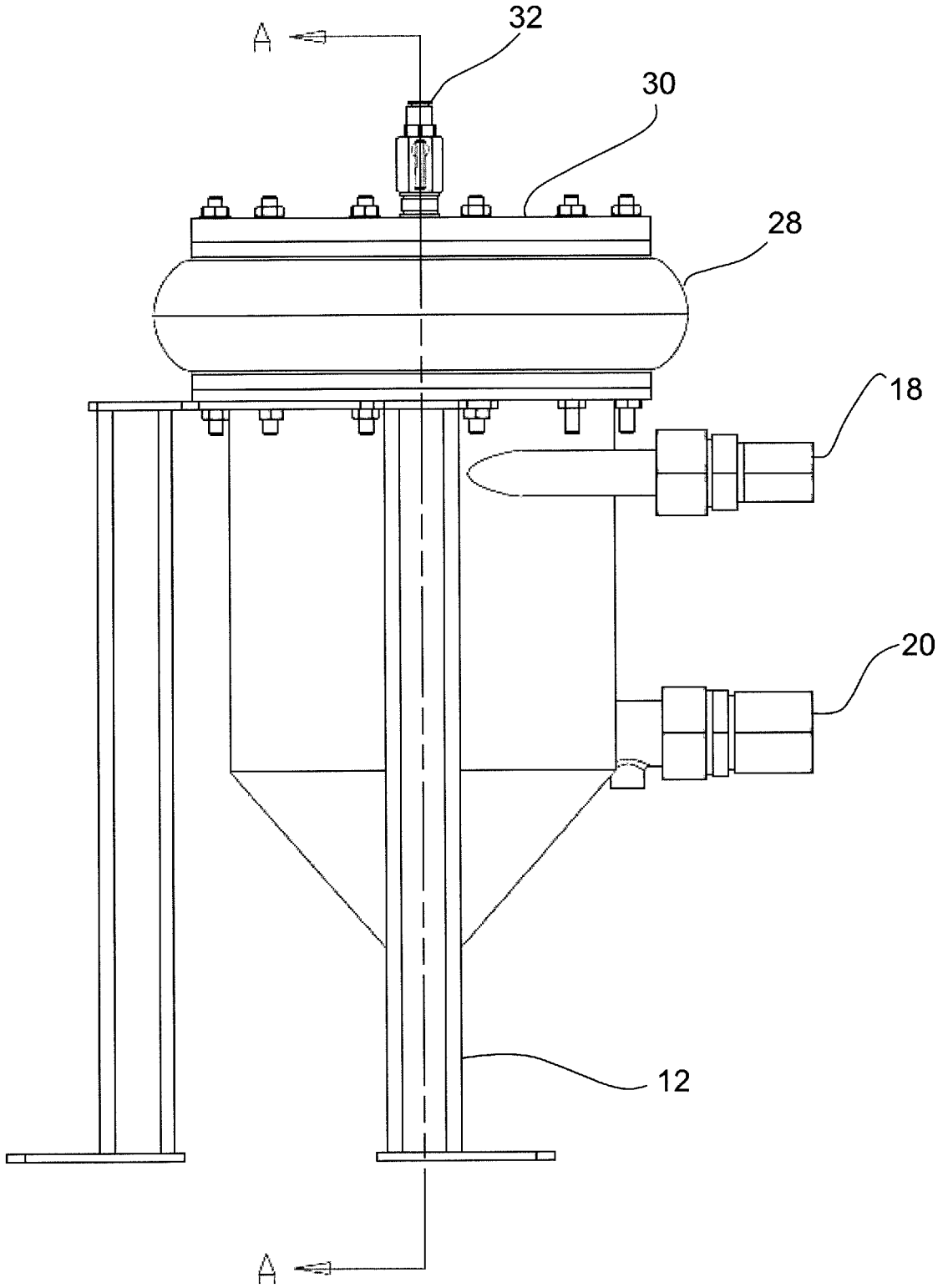
FIG. 6 shows a side view of the hydraulic reservoir of FIG. 1.
Figure 7:
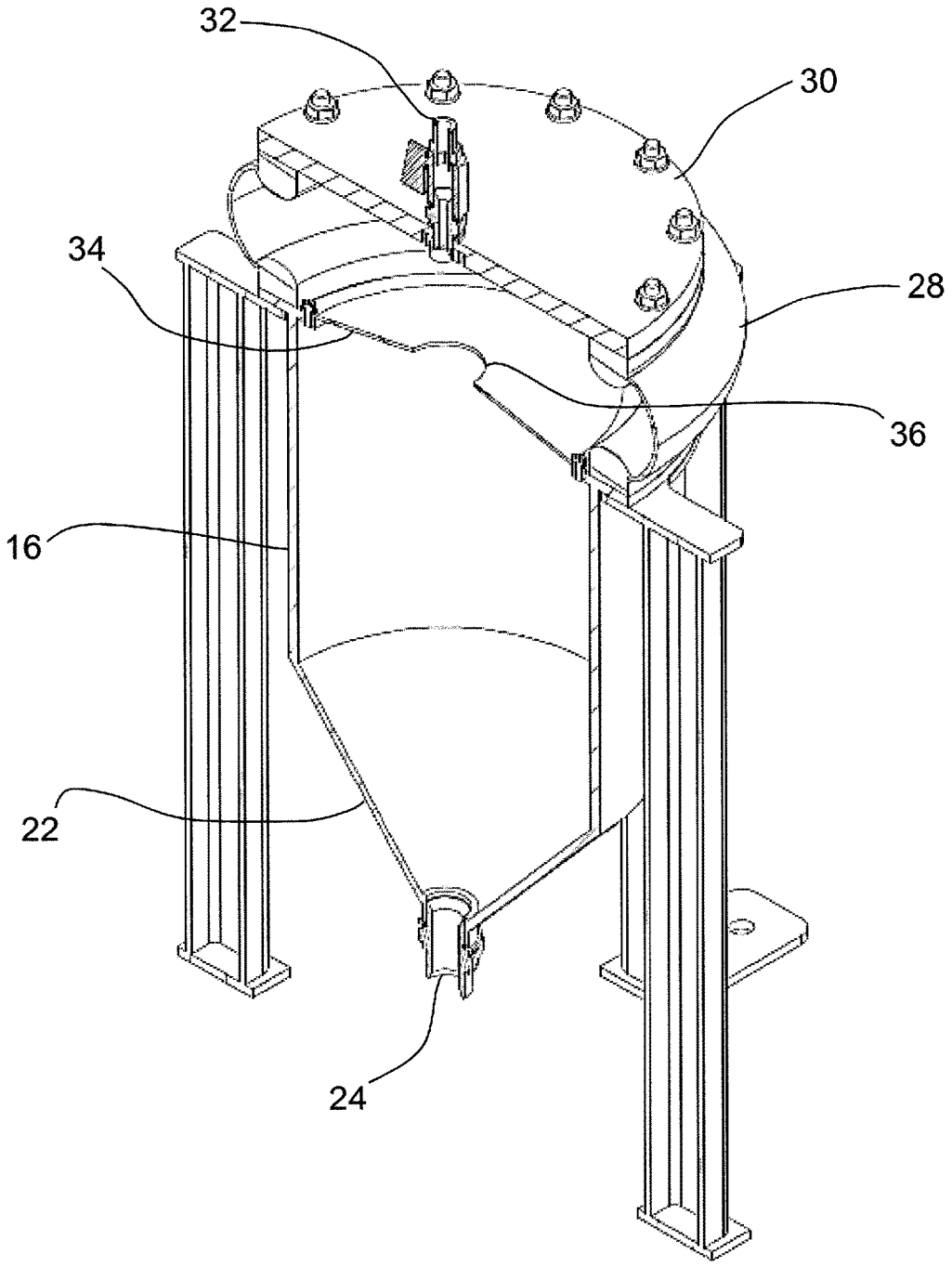
FIG. 7 shows a perspective sectional view along A-A in FIG. 6.

FIG. 6 shows a side view of the hydraulic reservoir of FIG. 1. FIG. 7 shows a perspective sectional view along A-A in FIG. 6, which clearly illustrates the shape of the diffuser plate 34 and the internal shapes of the vortex chamber 16 and the upper chamber 26. The diffuser plate 34 separates the vortex chamber 16 from the upper chamber 26. The rubber expansion bellows 28 is mounted to the top of the vortex chamber 16 and to the lid 30.

Figure 8:
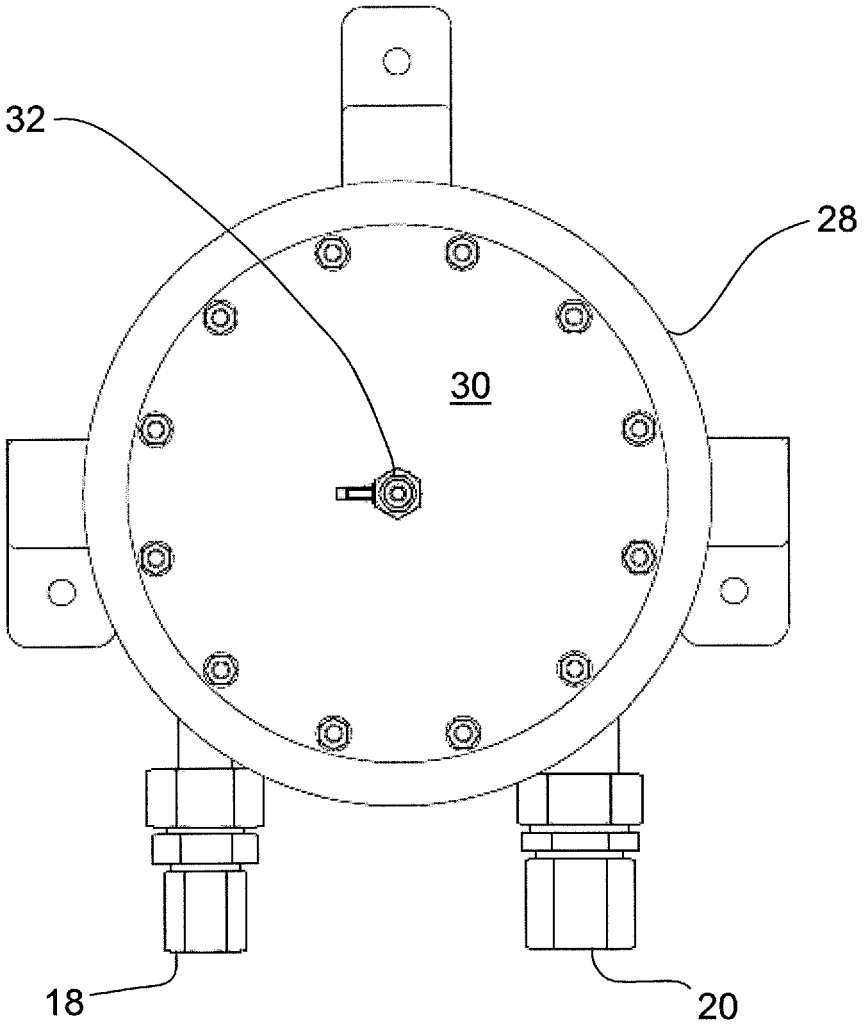
FIG. 8 shows a top plan view of the hydraulic reservoir of FIG. 1.

FIG. 8 shows a top plan view of the hydraulic reservoir of FIG. 1.

Figure 9:
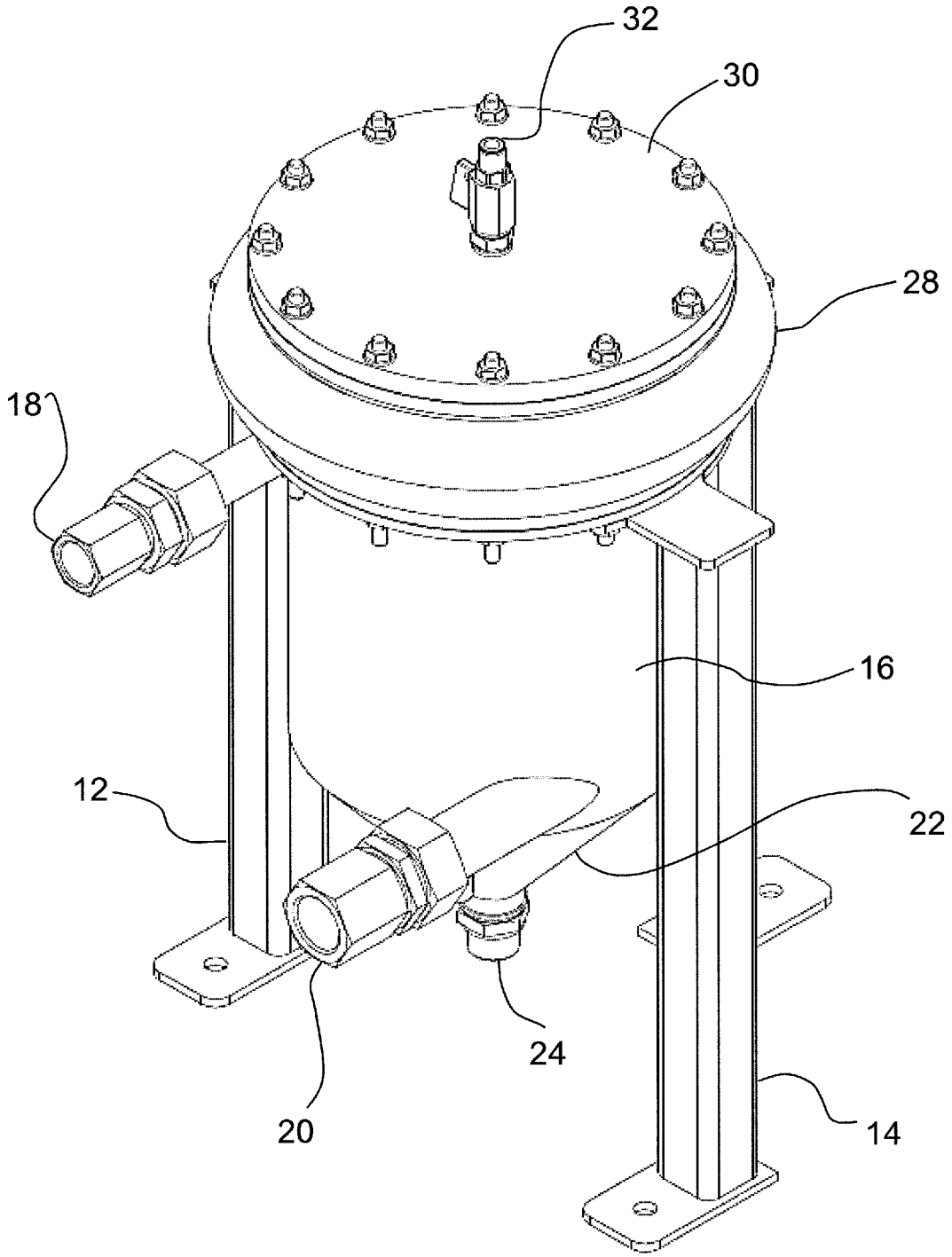
FIG. 9 shows another perspective view of the hydraulic reservoir of FIG. 1.

FIG. 9 shows another perspective view of the hydraulic reservoir of FIG. 1.

Figure 10:
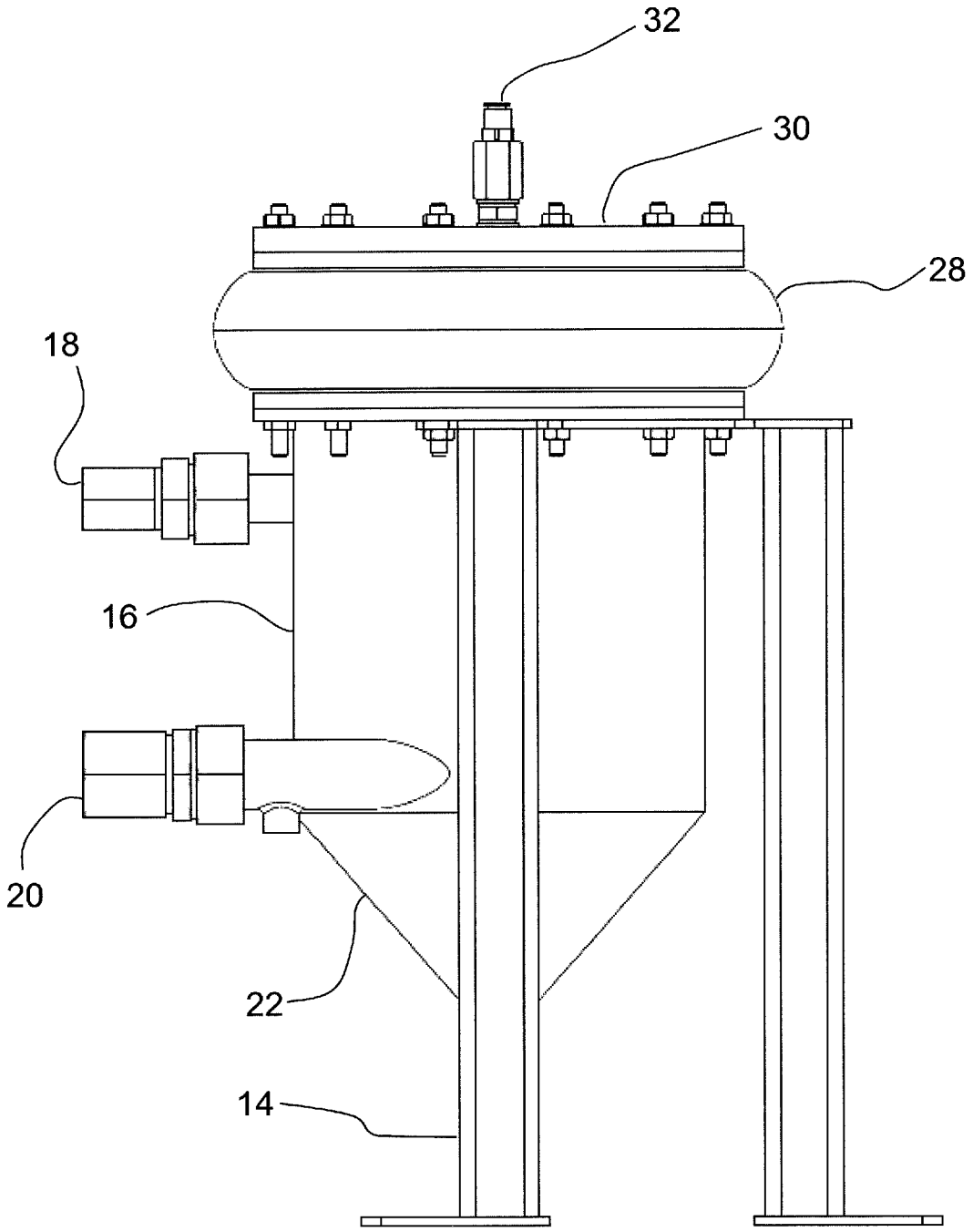
FIG. 10 shows another side view of the hydraulic reservoir of FIG. 1, from the opposite side to FIG. 6.

FIG. 10 shows another side view of the hydraulic reservoir of FIG. 1, from the opposite side to FIG. 6.

Figure 11:
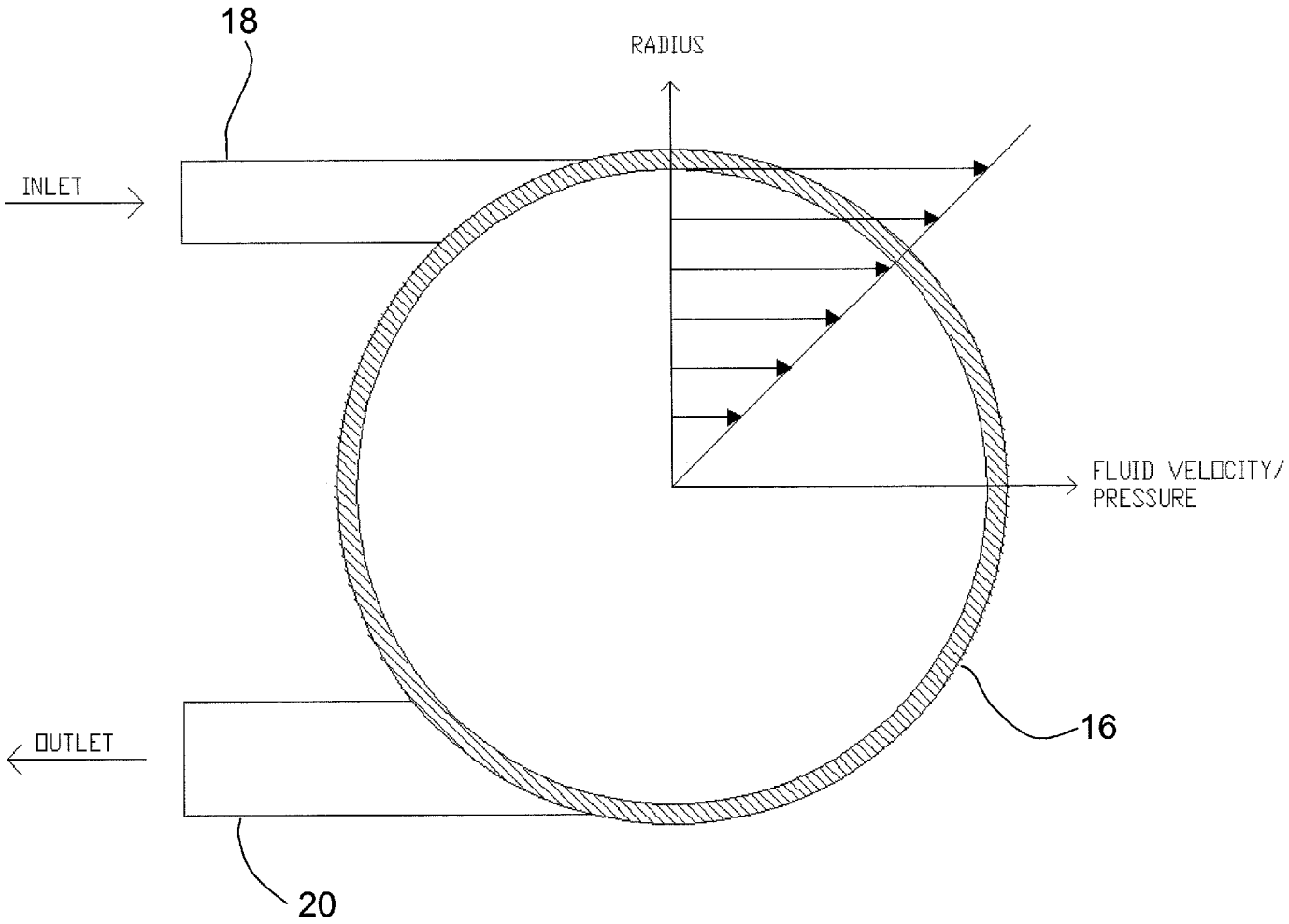
FIG. 11 shows a schematic axial sectional view of the vortex chamber of the hydraulic reservoir according to an embodiment of the invention, with the fluid velocity and, equivalently, fluid pressure at different radii being superimposed by arrows.

FIG. 11 shows a schematic axial sectional view of the vortex chamber of the hydraulic reservoir according to an embodiment of the invention, with the fluid velocity and, equivalently, fluid pressure at different radii being superimposed by arrows.

The principle of operation of the apparatus will now be explained.

In operation the reservoir is connected in a hydraulic system at the return line 18 and the suction line 20. The reservoir is entirely filled with hydraulic fluid. Any air bubbles in the reservoir rise to the upper chamber 26 and the bleed valve 32 can be operated to ensure no free air is present in the reservoir. The transparent lid 30 makes it possible for the operator to confirm that no free air is present in the reservoir.

Hydraulic fluid enters the vortex chamber 16 tangentially at junction 42 and is forced into a circular flow path by virtue of the cylindrical shape of the inner wall of the vortex chamber 16. This flow pattern generates a fluid velocity profile similar to that of a forced vortex within the chamber, meaning that the tangential velocity of the fluid increases with increasing values of the radius of the vortex. This is illustrated schematically in FIG. 11. The centrifugal force developed by this velocity profile means that a similar pressure profile is developed. The fluid pressure increases with increasing radius values. Therefore, a low pressure is generated in the centre of the vortex chamber 16 and a high pressure on the walls of the vortex chamber. This low pressure draws the less dense entrained air into the centre of the vortex chamber 16 where it rises through the aperture 36 in the centre of the diffuser plate 34 and up to the upper chamber 26 where it is vented using the bleed valve 32.

A higher flowrate entering the vortex chamber in turn means a higher mean vortex velocity. This generates a steeper pressure gradient and more efficient separation of air from the hydraulic fluid.

Because of the higher pressure developed on the internal wall of the vortex chamber 16, the suction line 20 to the pump also sees this higher pressure. This means that a smaller pump inlet can be used without running the risk of cavitation. In a similar way, the drain port 24 located at the bottom centre of the vortex reservoir experiences the same low pressure generated in the centre of the chamber. By connecting the pump case drain to this port 24, the pressure differential between pump inlet and case pressure can be increased, effectively increasing pump efficiency and protecting low pressure seals within the pump from seeing excessive pressure.

Dissolved air in the fluid is removed by taking advantage of the natural operation of a hydraulic system. Dissolved air is separated from a fluid when the fluid suddenly passes from a state of high pressure to a state of low pressure, such as the sudden opening of a valve or passing through a hydraulic motor. During these operations, the dissolved air is forced into an entrained state where it is then separated in the vortex chamber 16.

Because the reservoir is essentially a "closed" system the fluid within never comes into contact with atmosphere, preventing air from dissolving back into the fluid. This means that the longer the system is in commission the lower the percentage of the dissolved air in the fluid will become. Not allowing the fluid to come into contact with atmosphere has the added benefit of preventing moisture absorption and condensation from humid air as well as preventing the ingress of other airborne contaminants.

As the fluid is completely separate from atmosphere, the present inventors have devised a method of controlling excessive internal pressure build up due to thermal expansion of the fluid. This is achieved by the inclusion of expansion bellow 28 as part of the upper chamber, and above the vortex chamber. This bellow can rise and fall with the constantly changing volume of fluid within the system maintaining a substantially constant mean internal pressure. This bellow also takes up the volume change caused by the slight compressibility of the fluid when under high pressure from the pump.

The diffuser plate 34 serves the purpose of preventing the vortex from continuing into the upper chamber 26 where it would induce an unnecessary force on both the bellow 28 and lid 30. The tapered construction better allows the separated air to rise along the central axis of the reservoir.

A substantial advantage of the reservoir is that the removal air from the fluid is promoted. This has a number of advantages associated with it. The first and clearest of these is that the volume of hydraulic fluid required can be considerably reduced. This is because the returning fluid is not required to stand to allow air to rise naturally to the surface before being drawn back into the pump. This also means that expensive baffled reservoir designs can be done away with.

Furthermore, the degradation of hydraulic fluid due to oxidation can be a significant factor in the performance of hydraulic systems. The reduction of contact of the hydraulic fluid with air therefore provides a significant advantage to reduce or avoid oxidation.

Ensuring no air is entering the pump provides the substantial benefits of helping to maintain extended pump life and performance while reducing the risk of cavitation. Another advantage of the removal of air is the reduction of the compressibility of the working fluid. The less compressible the fluid, the more efficient it is at transferring pressure energy. This means that the overall hydraulic system efficiency is increased and a higher mechanical output can be realised. Air is also responsible for increasing the rate of degradation of hydraulic oil.

With no requirement for the hydraulic fluid to breathe means that the ingress of moisture into the fluid is substantially (preferably completely) removed as is the reintroduction of air into the fluid when returning to the reservoir. Essentially this means that the system becomes more efficient over time, since each passage through the vortex reservoir will further remove entrained air from the hydraulic fluid.

The positive pressure in the outlet line (suction line) means that a smaller pump inlet can be used. This increased pressure also means that pumps can be run at higher speeds before cavitation occurs, meaning a smaller pump can be used to produce the required system flowrate. The positive pump suction pressure also allows for greater flexibility in the physical location of the pump in relation to the reservoir.

The reservoir is also entirely scalable to allow for system flowrates of different sizes.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

All references referred to above are hereby incorporated by reference.

The invention claimed is:

1. A hydraulic reservoir comprising:

a vortex chamber having a substantially cylindrical internal wall surface;

a hydraulic fluid return line entering substantially tangentially to the internal wall surface of the vortex chamber;

a hydraulic fluid suction line exiting substantially tangentially from the internal wall surface of the vortex chamber;

an upper chamber, disposed in use above the vortex chamber and in fluid communication with the vortex chamber, wherein the upper chamber is capable of expansion and/or contraction in use in order to adjust continuously to the volume of the hydraulic fluid to be accommodated in the hydraulic reservoir.

2. A hydraulic reservoir according to claim 1 wherein the upper chamber has a flexible wall portion adapted to flex to provide the required expansion and/or contraction in use.

3. A hydraulic reservoir according to claim 2 wherein the flexible wall portion comprises bellows.

4. A hydraulic reservoir according to claim 1 wherein the upper chamber has a minimum volume, defined by the limit of available contraction, and a maximum volume, defined by the limit of available expansion, wherein the ratio of maximum volume to minimum volume is at least 1.03.

5. A hydraulic reservoir according to claim 1 wherein the upper chamber has a transparent cover located at its upper end.

6. A hydraulic reservoir according to claim 1 wherein there is a bleed valve provided at the upper extremity of the upper chamber, to allow trapped air to be bled from the upper chamber in use.

7. A hydraulic reservoir according to claim 1 wherein the vortex chamber and the upper chamber are separated by a diffuser plate.

8. A hydraulic reservoir according to claim 7 wherein the diffuser plate has a shape which tapers upwardly from a periphery of the diffuser plate towards an aperture formed in the diffuser plate.

9. A hydraulic reservoir according to claim 1 wherein the hydraulic fluid return line enters the vortex chamber at an upper portion of the vortex chamber.

10. A hydraulic reservoir according to claim 1 wherein the hydraulic fluid suction line exits the vortex chamber at a lower portion of the vortex chamber.

11. A hydraulic system including a hydraulic pump operatively linked to a hydraulic reservoir, the hydraulic reservoir comprising:

a vortex chamber having a substantially cylindrical internal wall surface;

a hydraulic fluid return line entering substantially tangentially to the internal wall surface of the vortex chamber;

a hydraulic fluid suction line exiting substantially tangentially from the internal wall surface of the vortex chamber;

an upper chamber, disposed in use above the vortex chamber and in fluid communication with the vortex chamber, wherein the upper chamber is capable of expansion and/or contraction in use in order to adjust continuously to the volume of the hydraulic fluid to be accommodated in the hydraulic reservoir.

12. A marine pleasure craft having a hydraulic system including a hydraulic pump operatively linked to a hydraulic reservoir, the hydraulic reservoir comprising:

a vortex chamber having a substantially cylindrical internal wall surface;

a hydraulic fluid return line entering substantially tangentially to the internal wall surface of the vortex chamber;

a hydraulic fluid suction line exiting substantially tangentially from the internal wall surface of the vortex chamber;

an upper chamber, disposed in use above the vortex chamber and in fluid communication with the vortex chamber, wherein the upper chamber is capable of expansion and/or contraction in use in order to adjust continuously to the volume of the hydraulic fluid to be accommodated in the hydraulic reservoir.

13. A method for the operation of a hydraulic reservoir, the hydraulic reservoir comprising:

a vortex chamber having a substantially cylindrical internal wall surface a hydraulic fluid return line entering substantially tangentially to the internal wall surface of the vortex chamber a hydraulic fluid suction line exiting substantially tangentially from the internal wall surface of the vortex chamber an upper chamber, disposed in use above the vortex chamber and in fluid communication with the vortex chamber, the method including the step:

directing hydraulic fluid into the vortex chamber along the hydraulic fluid return line and extracting hydraulic fluid from the vortex chamber along the hydraulic fluid suction line, thereby generating a vortex flow in the vortex chamber, dissolved air, if present, becoming entrained into bubbles which rise to the upper chamber, expansion and/or contraction of the upper chamber being provided in use in order to adjust continuously to the volume of the hydraulic fluid to be accommodated in the hydraulic reservoir.

14. A method according to claim 13 wherein there is a bleed valve provided at the upper extremity of the upper chamber, the method further including the step of bleeding trapped air from the upper chamber using the bleed valve.

15. A method according to claim 13 wherein the upper chamber has a flexible wall portion, the method including flexure of the flexible wall portion to during flow of hydraulic fluid in the vortex chamber, thereby providing the required expansion and/or contraction of the upper chamber.

16. A method according to claim 15 wherein the volume of the hydraulic fluid to be accommodated in the hydraulic reservoir varies, at least in part, due to thermal expansion of the hydraulic fluid.

17. A method according to claim 13 wherein the vortex chamber and the upper chamber are separated by a diffuser plate, the diffuser plate having a shape which tapers upwardly from a periphery of the diffuser plate towards an aperture formed in the diffuser plate, bubbles formed in the vortex chamber thereby being guided into the upper chamber.

18. A method according to claim 17 wherein the diffuser plate substantially prevents the vortex in the vortex chamber extending into the upper chamber.

19. A method according to claim 13 wherein the hydraulic fluid in the hydraulic reservoir is not in contact with the atmosphere.

20. A method according to claim 13 wherein the hydraulic fluid in the hydraulic reservoir is at a pressure above atmospheric pressure.

* * * * *